US009033214B2

(12) United States Patent
Siddle et al.

(10) Patent No.: US 9,033,214 B2
(45) Date of Patent: May 19, 2015

(54) CASH HANDLING SYSTEM

(75) Inventors: Graham Siddle, Hartlebury (GB); Andrew Hawkes, Hartlebury (GB)

(73) Assignee: Airtube Technologies Limited, Glostershire (GB)

( * ) Notice: Subject to any disclaimer, the term of this patent is extended or adjusted under 35 U.S.C. 154(b) by 274 days.

(21) Appl. No.: 13/160,738

(22) Filed: Jun. 15, 2011

(65) Prior Publication Data

US 2011/0255945 A1 Oct. 20, 2011

Related U.S. Application Data

(63) Continuation-in-part of application No. 12/326,451, filed on Dec. 2, 2008, now Pat. No. 7,980,792.

(30) Foreign Application Priority Data

Dec. 9, 2007 (GB) ..... 0723795.1

(51) Int. Cl.
*G06F 17/00* (2006.01)
*G07D 11/00* (2006.01)

(52) U.S. Cl.
CPC ..... *G07D 11/0024* (2013.01); *G07D 11/0087* (2013.01)

(58) Field of Classification Search
USPC ..... 235/375, 379, 380; 271/9.08, 10.01, 11, 271/20, 90, 252; 406/180, 184–190; 414/751.1; 902/33; 109/45, 46
See application file for complete search history.

(56) References Cited

U.S. PATENT DOCUMENTS

| | | | | |
|---|---|---|---|---|
| 5,101,979 | A | 4/1992 | Uno et al. | |
| 7,328,084 | B1 | 2/2008 | Hoganson et al. | |
| 7,980,792 | B2 * | 7/2011 | Siddle et al. | 406/184 |

FOREIGN PATENT DOCUMENTS

| | | | |
|---|---|---|---|
| DE | 10002641 | A1 | 8/2001 |
| EP | 1001387 | A1 | 5/2000 |
| WO | WO91/00578 | | 1/1991 |
| WO | WO03/101867 | A1 | 12/2003 |
| WO | WO2004/088601 | A1 | 10/2004 |

OTHER PUBLICATIONS

The PCT Search Report issued Jul. 9, 2012 in connection with PCT/GB2012/000072.
European Office Action dated Apr. 2, 2013 issued in related European Patent Application No. 08253883.6.
The European Search Report issued in connection with European Patent Appl. No. 08253883.6, Apr. 2, 2009.

* cited by examiner

*Primary Examiner* — Michael G Lee
*Assistant Examiner* — Tabitha Chedekel
(74) *Attorney, Agent, or Firm* — Berliner & Associates

(57) ABSTRACT

The invention relates to a system for transporting a sheaf of notes from a storage location to a dispensing outlet. The system comprises a conveyor apparatus, a carrier within which the sheaf is transported through the conveyor apparatus, and an extractor for removing the sheaf from the carrier. The carrier comprises a resiliently biased gripper for gripping the sheaf with a first gripping force. The extractor comprises an extraction gripping device configured to grip the sheaf with a second gripping force, which is greater than the first gripping force.

23 Claims, 13 Drawing Sheets

CASH HANDLING SYSTEM

CROSS REFERENCE TO RELATED APPLICATIONS

This application claims the benefit of and is a continuation in part of U.S. patent application Ser. No. 12/326,451, which was filed on Dec. 2, 2008, now U.S. Pat. No. 7,980,792 which claimed the of U.K. Patent Application no. 0723795.1, filed on Dec. 9, 2007. patent application Ser. No. 12/326,451, is hereby incorporated by reference in its entirety.

FIELD OF THE INVENTION

The present invention relates to an improved system for handling a sheaf of notes, particularly bank notes or the like.

BACKGROUND OF THE INVENTION

GB-A-2,305,901 describes a money handling system in which a tube conveyor system is used to convey money between one location and a remote storage location. The money is conveyed in a carrier, which is placed (usually manually) into a sending station, and received at a receiving station situated at or close to the storage location, where the carrier is opened and the money extracted (again usually manually).

EP-A-0841644 describes a cash handling system in which parcels of bank notes are delivered to a collection location, such as an ATM machine. The system described is illustrated in FIGS. 1 and 2, and employs a "pick and place" mechanism 15 whereby a parcel of cash 21 is extracted from a storage unit 11 and delivered to the collection point 22. The "pick and place mechanism" 15 includes a carriage 17 that moves along a rail 16 or track, with an arm 18 that carries a jaw assembly 19. The jaws of the jaw assembly 19 can be opened or closed so as to grip or release a parcel. Thus, when there is a demand for cash to be delivered to the collection point 22, the carriage 17 is moved along the rail 16 until the jaw assembly 19 is aligned with a parcel 21 in the storage unit 11. The jaws are activated to grip the parcel, and the carriage 17 is then moved along the rail 16 to a collection box which is open to receive the sheaf and is then closed and moved to the collection point 22, where the jaws are opened to release the parcel.

The system also includes a conveyor arrangement for replenishing parcels in the storage unit 11. This is illustrated in FIG. 2. Within a vault or secure cash room 24 a conventional bank note counting and dispensing mechanism 25 compiles parcels of bank notes of predetermined value, and supplies them to the jaw assembly of a pick and place mechanism 26. The mechanism 26 then transports parcels individually from the dispensing mechanism 25 and inserts them into the carrier residing in the sending station 28 of a pneumatic tube conveyor system 27. The conveying tube of the system 27 terminates at its opposite end in a receiving station 29 adjacent the storage unit 11 and accessible to the jaw assembly 19 of the pick and place mechanism 15. The mechanism 26 passes the parcel to the station 28 where it is introduced into a carrier and the carrier is dispatched along the tube system to the receiving station 29. Within the receiving station 29 the parcel is either removed from the carrier and presented for access by the jaw assembly 19, or alternatively the carrier itself is opened to provide access for the jaw assembly 19 to the parcel. Thereafter the mechanism 15 retrieves the parcel from the station 29 and introduces it into the storage unit 11.

These prior art cash handling systems rely on established designs of carriers for the pneumatic conveying. When the carrier arrives at its destination receiving station the parcel of notes has to be removed from the carrier (possibly involving opening of the carrier). Established carrier designs usually include a canister that can be closed and opened by unscrewing or releasing a closure device. It is clearly undesirable, especially when providing cash to re-stock an ATM machine, for this operation to be performed manually. Automation of the process may involve a complex series of operations to ensure that the parcel of notes is correctly picked out of the carrier and delivered to its storage location.

BRIEF SUMMARY OF THE INVENTION

The present invention has been conceived with the foregoing in mind

According to a first aspect of the present invention there is provided a system for transporting a sheaf of notes from a storage location to a dispensing outlet. The system comprises a conveyor apparatus, a carrier within which the sheaf is transported through the conveyor apparatus, and an extractor for removing the sheaf from the carrier. The carrier comprises a resiliently biased gripper for gripping the sheaf with a first gripping force. The extractor comprises an extraction gripping device configured to grip the sheaf with a second gripping force, which is greater than the first gripping force.

Preferably the conveyor apparatus comprises a pneumatic tube conveyor.

It is an advantage of the present invention that, because the resilient gripper grips the sheaf with a force that is less than the force of the extractor, then the extractor can remove the sheaf from the carrier without the need to activate any mechanism in the carrier itself. This means that the carrier does not have to be provided with any activation means, power supply or control signaling. Another advantage is that the sheaf is held in position in the carrier by the gripper, rather than being loosely deposited inside the carrier. This means that when the carrier is positioned at a location where the sheaf is to be extracted, the extractor will find the sheaf in correct alignment for extraction.

In embodiments of the invention, the gripper comprises a pair of opposing gripping surfaces biased towards each other. The gripping surfaces may be surfaces of a pair of plates. The plates may be shaped to provide a mouth for insertion of a sheaf between the plates. The plates may also be shaped to provide an ungripped portion of the sheaf in the carrier, the extractor being configured to grip the sheaf at the ungripped portion to remove the sheaf from the carrier.

In embodiments of the invention, the system further comprises a depositing mechanism for inserting a sheaf of notes into the carrier. The depositing mechanism may be configured to prize open the gripper and insert the sheaf into the carrier. The depositing mechanism may comprise a shaped member whereby insertion of the shaped member between the gripping surfaces prizes them apart to open the gripper.

According to a second aspect of the present invention there is provided a carrier for transporting a sheaf of notes through a conveyor. The carrier comprises a gripper having a pair of substantially parallel gripper plates moveable towards one another for gripping the sheaf. A biasing arrangement is configured to bias the gripper plates towards one another with a predetermined gripping force. The gripper plates are shaped so that a portion of the sheaf is not gripped between the plates thereby permitting extraction of the sheaf by an extractor gripping the sheaf at that portion with a force that is greater than the predetermined gripping force.

The plates may be shaped to receive the sheaf from an insertion direction substantially parallel to the gripping surfaces of the plates. Preferably, the plates having diverging opposing surfaces along an edge facing the insertion direction.

According to a third aspect of the invention there is provided an insertion device for inserting a sheaf of notes into a carrier. The carrier comprises a pair of gripper plates biased towards one another for gripping the sheaf of notes. The insertion device comprises a gripper for holding the sheaf and a plate separator.

In embodiments of the invention the gripper holds the sheaf with a gripping force that is smaller than the gripping force of the carrier gripper plates.

According to a fourth aspect of the present invention there is provided a system for processing notes, such as bank notes. The system comprises: a carrier comprising a gripper for gripping a sheaf of notes; a conveyor apparatus for conveying the carrier; and a processing station for receiving the carrier. The processing station comprises: an extractor for extracting the sheaf of notes from the carrier and inserting the notes into a note processor. The note processor comprises one or more of: a note counter, a note validator and a note recycler. A controller controls operation of the system.

The controller may comprise a computer or a microprocessor programmed with software for controlling operation of the system.

The system may be in a location remote from a central processor, and the computer may include a link and/or data output for communication with the central processor. The processing station may be enclosed within a housing constructed in accordance with ATM and/or safe grading standards, for example constructed of concrete and/or steel. Part, or all of the controller may be contained within the housing.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 3:
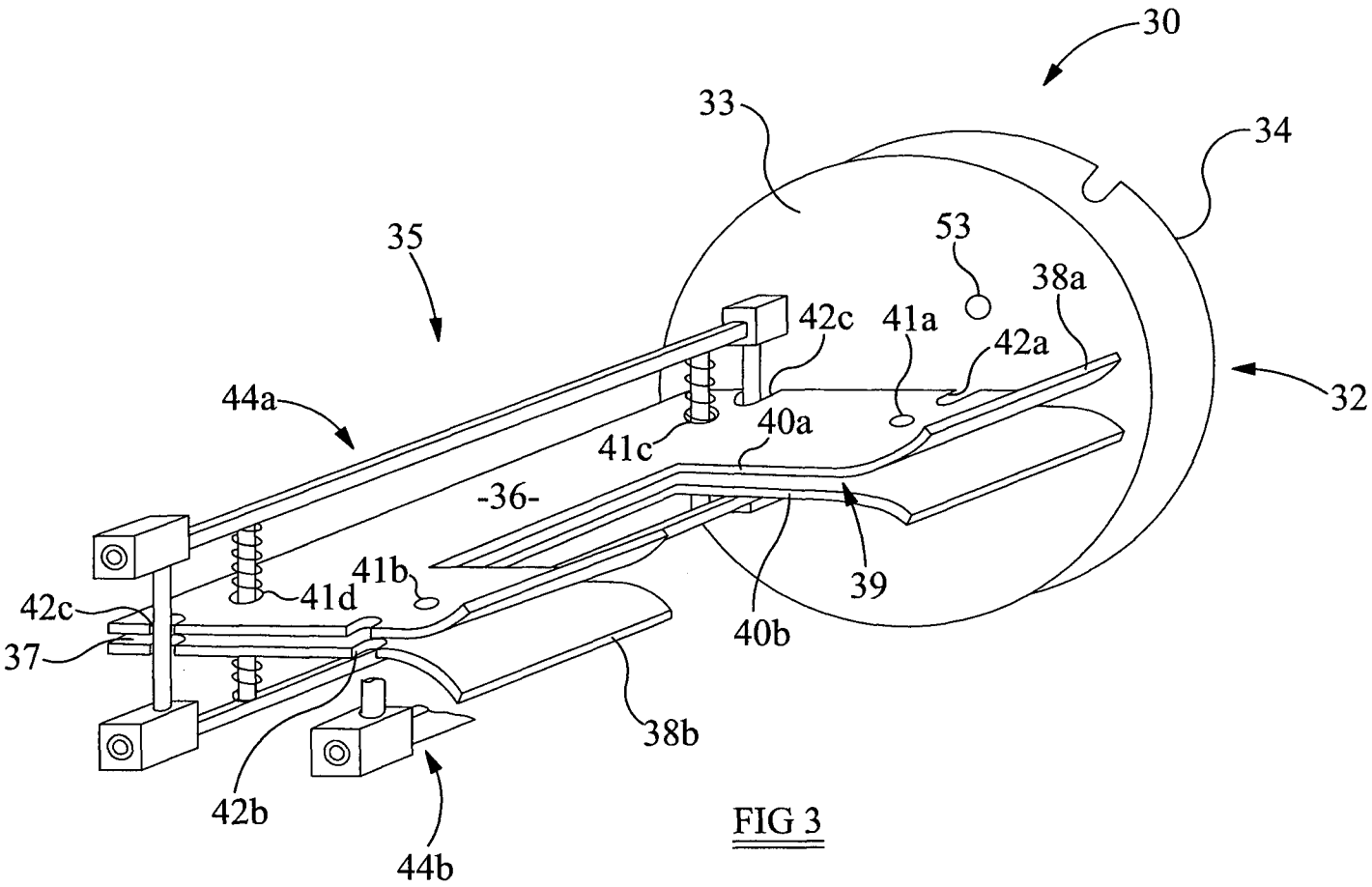
FIG. 3 is a partially cut-away illustration of a carrier in accordance with aspects of the present invention.

Referring to FIG. 3, a carrier 30 of the type suitable for use in a pneumatic tube conveying system, includes a disc-shaped end-piece 32 having an inner circular face 33 and an outer circular face 34. The end-piece 32 is disposed at one end of the carrier, while another similar end piece is disposed at the opposite end, but is not shown in FIG. 3 for clarity.

Figure 4:
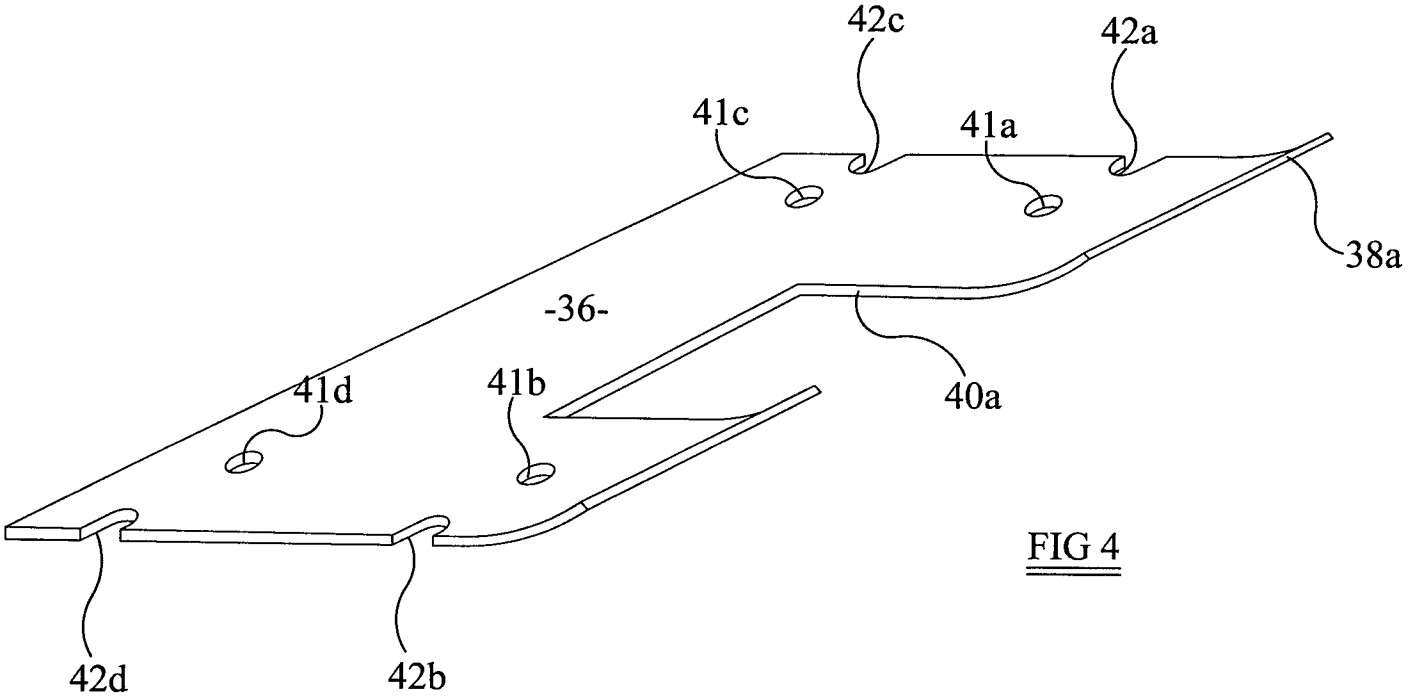
FIG. 4 illustrates a plate of a gripper forming part of the carrier of FIG. 3.

A gripper arrangement 35 is held in place between the end pieces and includes an upper gripper plate 36 and a lower gripper plate 37. The gripper plates 36, 37 are each preferably formed from a suitable metal or composite sheet by a pressing or stamping operation. The gripper plates 36, 37 are disposed one above the other to form a pair of gripping surfaces between which a sheaf of bank notes can be gripped. FIG. 4 shows the upper gripper plate 36 in isolation, using the same reference numerals as used in FIG. 3. As shown in FIG. 3, each of the gripper plates 36, 37, is bent to turn away from the other plate towards a longitudinal edge 38*a*, 38*b* of the respective plate 36, 37 so as to present a mouth that leads into a gap 39 between the plates. The purpose of this mouth will be described in more detail below. Each of the gripper plates also includes a rectangular cut-out 40*a*, 40*b*, which is open to the respective longitudinal edge 38*a*, 38*b*. The purpose of these cut-outs will be described in more detail below.

Each of the gripper plates 36, 37 also includes two pairs of longitudinally aligned holes 41*a*, 41*b* and 41*c*, 41*d*, disposed such that each of the holes 41*a-d* in the upper plate 36 is aligned with the corresponding hole 41*a-d* in the lower plate. Each of the gripper plates 36, 37 also includes two pairs of U-shaped cut-outs 42*a*, 42*b* and 42*c*, 42*d*, one cut-out of each pair at each end of each plate. Each pair of cut-outs 42*a*, 42*b* and 42*c*, 42*d* is longitudinally aligned with a respective pair of holes 41*a*, 41*b* and 41*c*, 41*d*.

Figure 5:
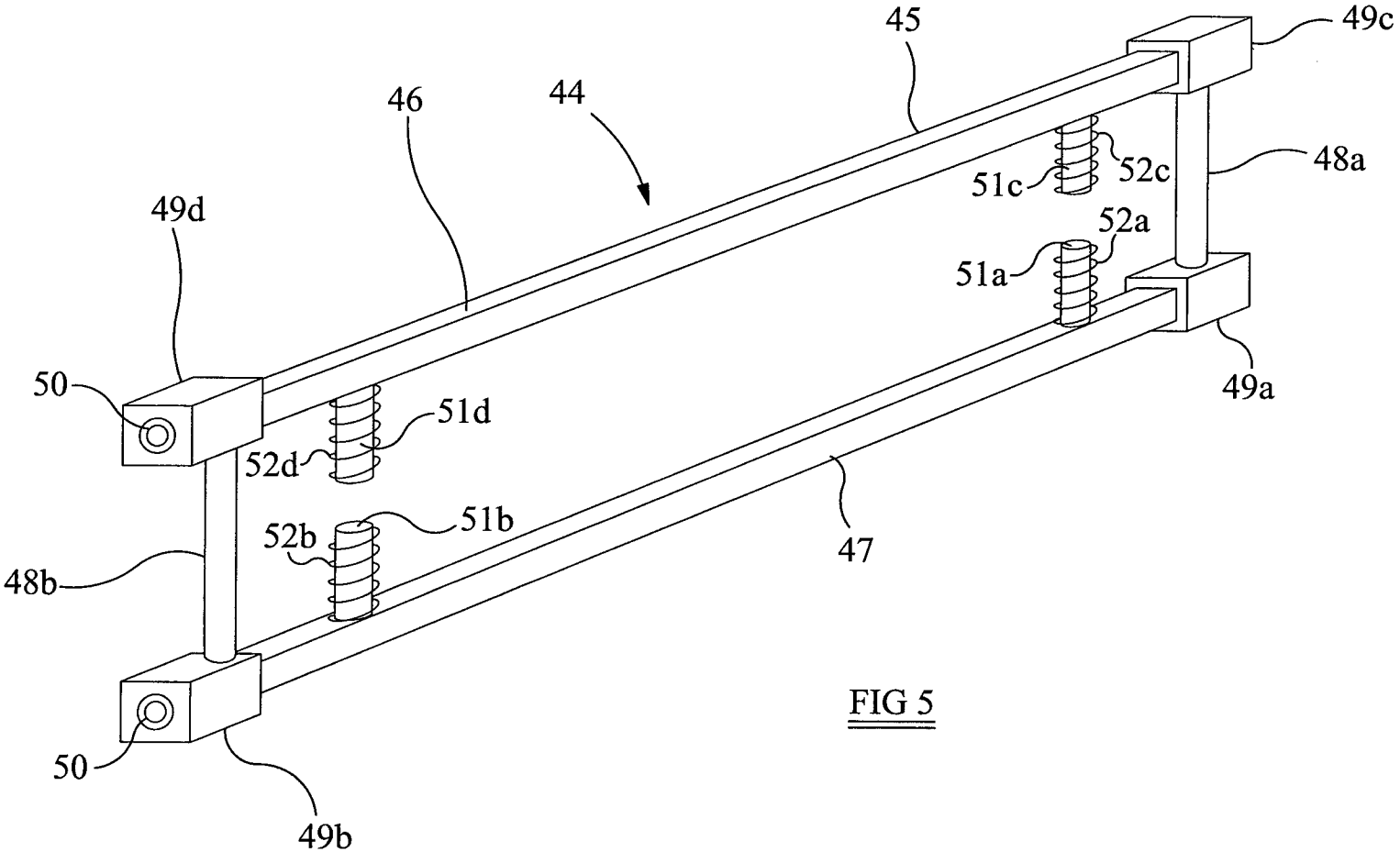
FIG. 5 illustrates a biasing arrangement for a gripper forming part of the carrier of FIG. 3.

Referring to FIG. 5, a biasing arrangement 44 comprises a frame 45 made up of an upper longitudinal square section member 46, a lower longitudinal square section member 47 and end members 48*a*, 48*b*. At each corner of the frame is a corner block 49*a-d* connecting a longitudinal square section member and an end member. The corner blocks each have an end face with a threaded hole 50. Extending inwardly of the frame 45 from each of the upper and lower longitudinal square section members 46, 47, are a pair of posts 51*a,b* and 51*c,d*. Each pair of posts 51*a,b* and 51*c,d* is positioned to align with a corresponding pair of holes 41*a,b* and 41*c,d* in the gripper plates. Each of the posts 51*a-d* has a diameter slightly smaller than the corresponding hole 41*a-d*, so that the posts can pass through the holes without interference. Around each of the posts 51*a-d* is an associated helical spring 52*a-d*. The diameter of each helical spring 52*a-d* is larger than that of the corresponding hole 41*a-d*.

Referring again to FIG. 3, the gripper arrangement 35 is assembled such that the gripper plates 36, 37 are supported between two parallel biasing arrangements 44*a,b* (although, for clarity, only part of the front biasing arrangement 44*b* is shown). The helical springs 41*a-d* exert a biasing force on the gripper plates 36, 37 tending to push them towards each other. The gripper plates 36, 37 are constrained by the end members 48*a,b* which are disposed to extend through the U-shaped cut-outs 42*a-d*. The cut-outs 42*a-d* thereby act as guides so that the gripper plates 36, 37 can only move towards or away from each other with, or against, the biasing action of the helical springs 52*a-d*. The biasing arrangements 44*a,b* are fastened to the end pieces 32 by means of screws (not shown) that pass through holes 53 in the end piece 32.

Figure 2:
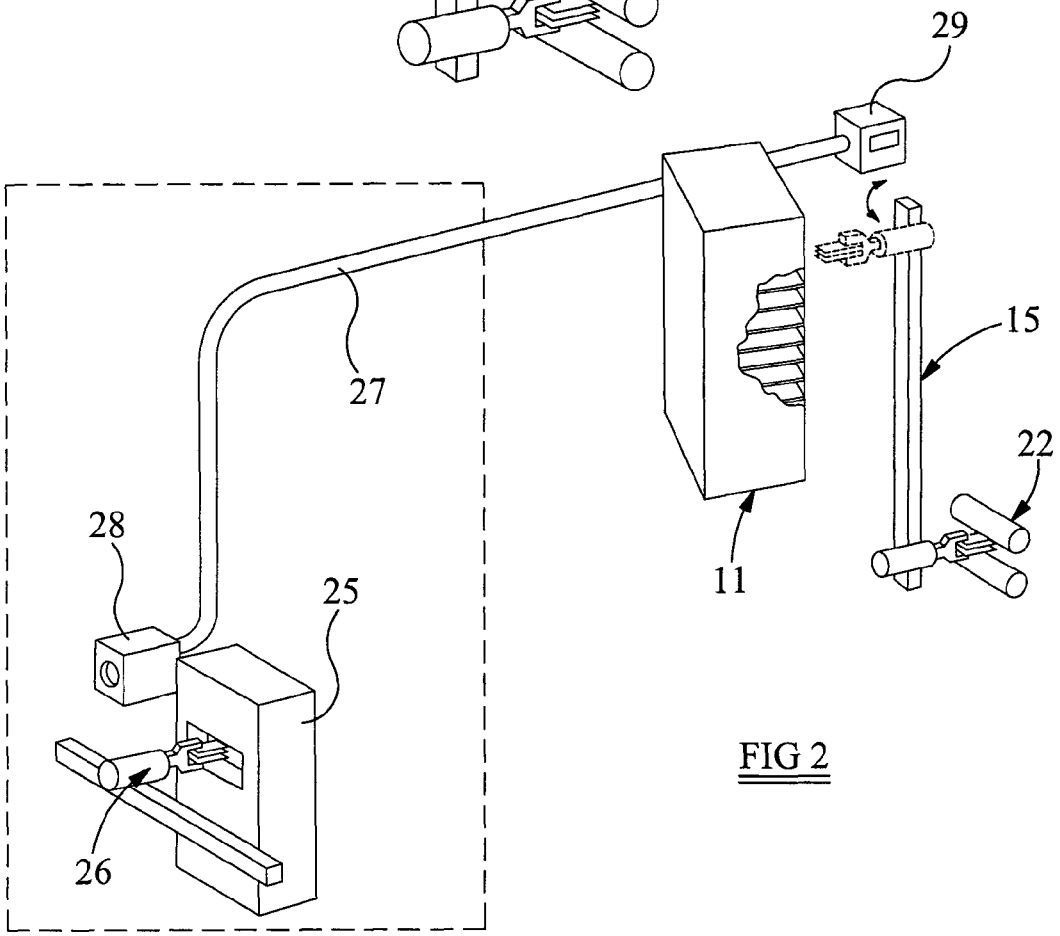
FIG. 2 is a diagrammatic illustration of a system for replenishing a cash storage unit of the type shown in FIG. 1.
Figure 6B:
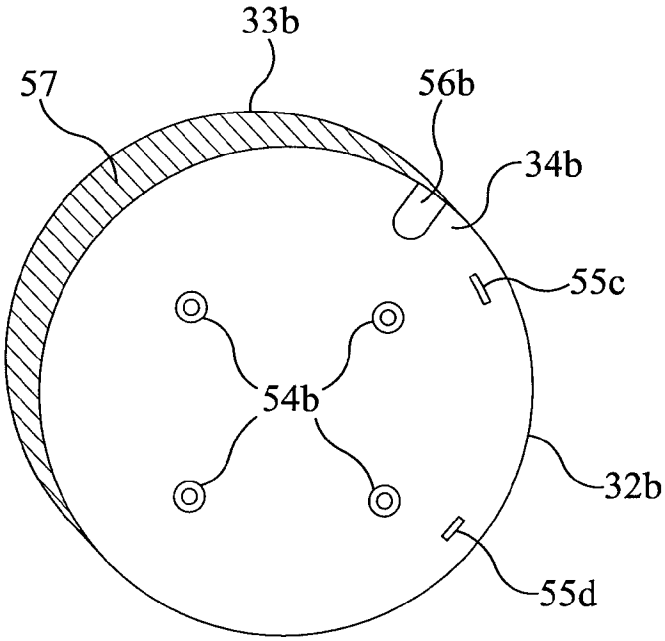
FIGS. 6*a* and 6*b* illustrate end views of each end of the carrier of FIG. 3.
Figure 6A:
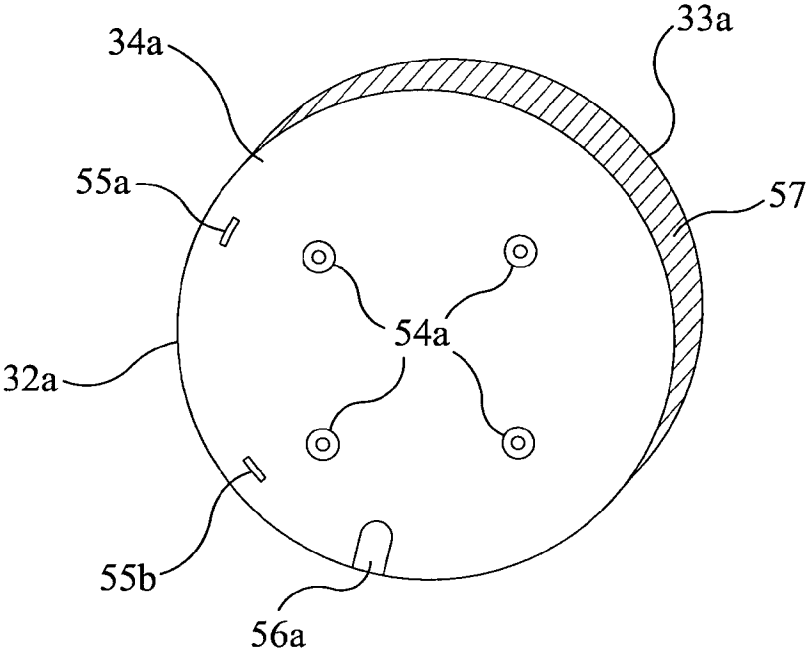

Referring to FIGS. 6*a*, and 6*b*, the end pieces 32*a*, 32*b* which form the end of the carrier 30 of FIG. 3, each include an inner circular face 33*a,b* and an outer circular face 34*a,b* and are formed from a suitable rigid metal or plastics material. Each of the end pieces 32*a*, 32*b* has four holes 54*a*, 54*b* through which screws (not shown) pass to fasten the biasing arrangements 44*a,b* as described above. Each end piece 32*a*, 32*b* also has a pair of slots 55*a,b* and 55*c,d* located close to the circumference and spaced apart by about 90 degrees. Each end piece 32*a*, 32*b* also has a cut-out 56*a,b* formed in the respective outer circular face 34*a*, 34*b* at a position on the circumference of the disc. When the carrier is positioned in a sending station 28 or receiving station 29, as shown in FIG. 2, the cut-outs 56*a,b* can be engaged by a rotation mechanism to rotate the carrier on its axis so that the gripper mechanism is correctly aligned to receive or dispense a sheaf of notes. Wrapped around the outside of each of the end pieces 32*a,b* is a material 57 that is provided to assist in the aerodynamics of the carrier. The material may have a roughened surface and may, for example, be of a hook-and-loop fastener material such as VelcroRTM .

Figure 7:
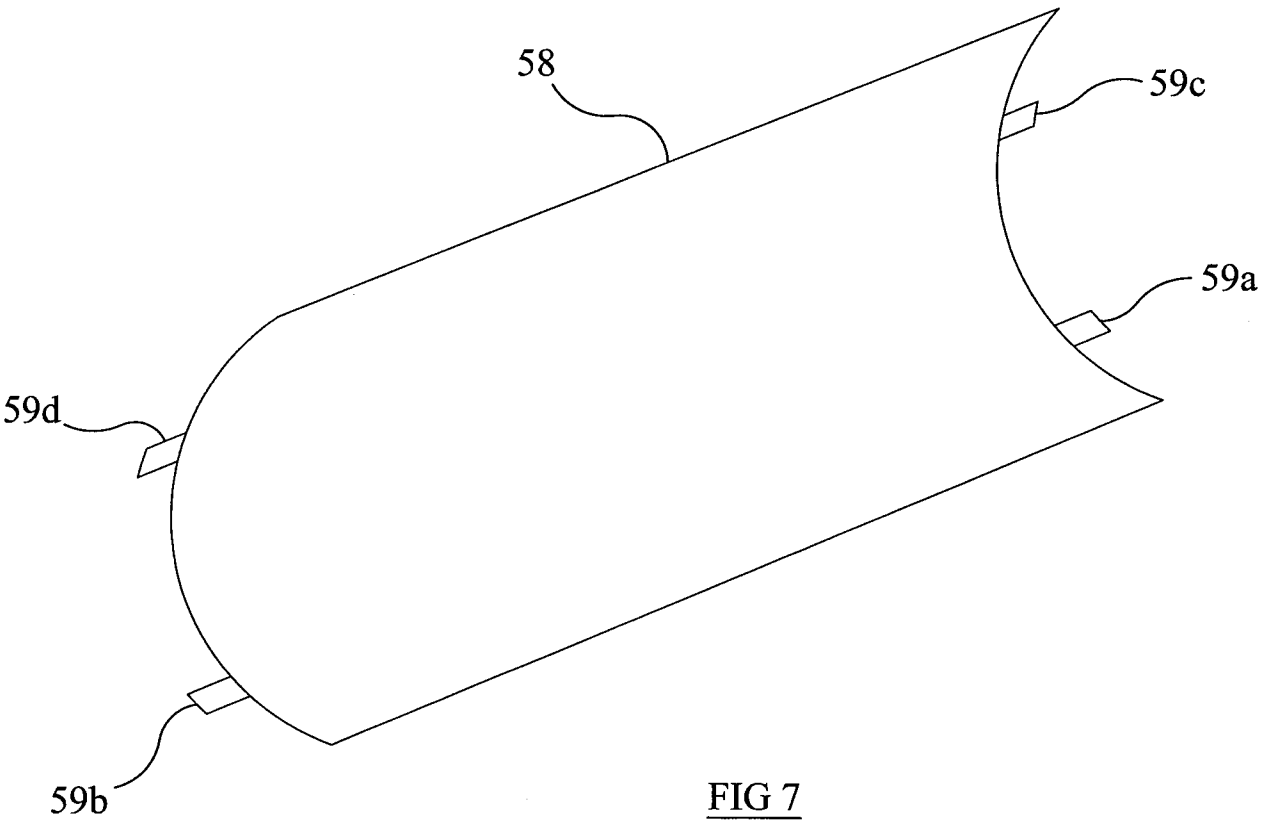
FIG. 7 illustrates a side wall for the carrier of FIG. 3.

Referring to FIG. 7, an outer wall 58 of the carrier is formed of a sheet material, such as a metal or plastics sheet. The outer wall has a part-cylindrical curve and pairs of tongues 59*a,b* and 59*c,d* extending longitudinally (i.e. axially). These tongues engage in respective ones of the slots 55*a-d* in the end pieces. Note that the wall 58 extends only around a rear portion of the circumference of the cylindrical carrier 30. The front of the carrier 30, through which a sheaf of notes is inserted and extracted, remains open to the side.

Figure 8:
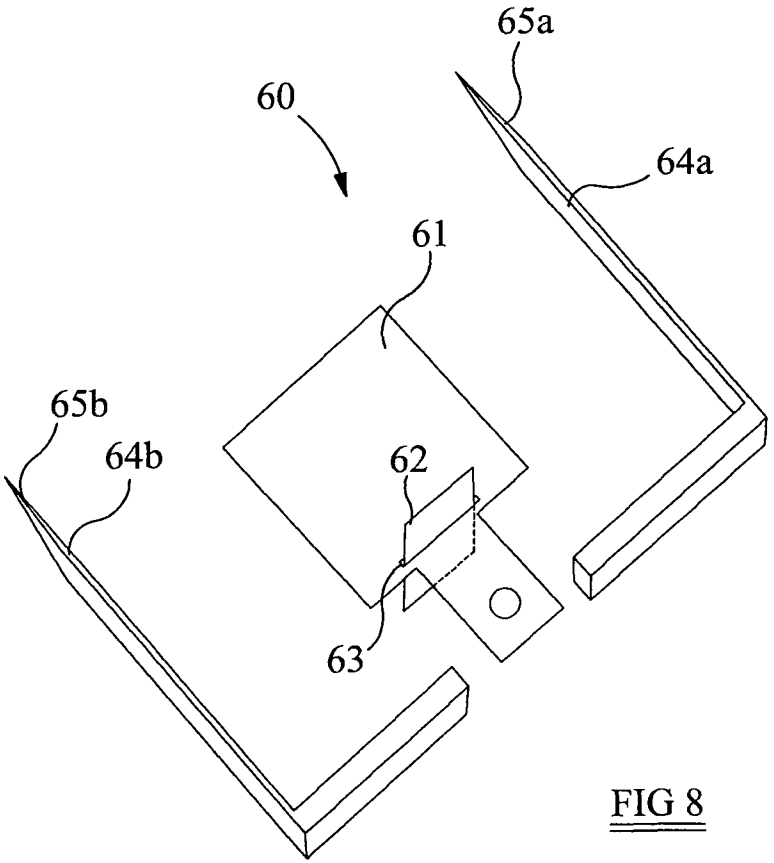
FIG. 8 illustrates part of an insertion device for inserting a sheaf of notes into the carrier of FIGS. 3 to 7.

Referring to FIG. 8, a depositing arrangement includes a device 60 that places a sheaf of notes into the carrier 30. The device 60 operates in a similar manner to the pick and place mechanism 26 of FIG. 2, and the principal features shown in FIG. 8 include a pair of gripper plates 61 (of which only one is shown) located one above the other so as to grip a sheaf of notes between them. The gripper plates 61 are slightly smaller than the rectangular cut-outs 40*a*, 40*b* in the gripper plates 36, 37 of the carrier. The gripper plates 61 are spring-loaded off a frame (not shown) to provide a gripping force, in a similar manner to, but with a smaller gripping force than, the gripper plates 36, 37 of the carrier. A stop member 62 extends perpendicular to the gripper plates 61 through slots 63. In addition, the depositing arrangement includes a pair of arms 64*a*, 64*b* that extend in a direction towards the carrier. The arms 64*a*, 64*b* are positioned so that when a sheaf of notes is held between the gripper plates 61, the sheaf will be located between (i.e. embraced by) the arms 64*a*, 64*b*. Each of the arms 64*a*, 64*b* has a tapered end portion 65*a*, 65*b*.

In use, an empty carrier 30 is delivered by the pneumatic conveyor system to a loading station, which is located in the position of the sending station 28 of FIG. 2. A sheaf of notes is collected by the device 60 of the depositing arrangement so that the sheaf is gripped between the plates 61. The sheaf is deposited into the carrier 30 by advancing the device 60 towards the carrier, which is aligned (as described above using the cut-outs 56*a*, 56*b*) so that the sheaf will enter into the mouth that is formed between the front edges 38*a,b* of the upper and lower gripper plates 36, 37. As the sheaf of notes is offered up to the carrier 30, the gripper plates 36, 37 are compressed together by the biasing action of the helical springs 52*a-d*. In order to open the gripper 35, the carrier 30 is rotated into the correct position by the station and a mechanical opening device then parts the gripper plates. In the embodiment shown, the tapered end portions 65*a*, 65*b* of the arms 64*a*, 64*b* enter the mouth that is formed between the front edges 38*a,b* of the upper and lower gripper plates 36, 37 as the device 60 is moved towards the carrier 30. The tapered shape of the arms pushes the plates 36, 37 apart against the biasing action of the springs 52*a-d*. Other mechanical devices may be provided for parting the gripper plates and also be within the scope of the present invention. By the time the sheaf of notes reaches the mouth, the gripper plates 36, 37 have been urged apart and the sheaf can be pushed all the way into the gap 39. The stop member 62 ensures that the sheaf is pushed all the way into the carrier 30. When the depositing device is withdrawn, removal of the mechanical force holding the plates apart and the biasing action of the helical springs 52*a-d* urges the gripper plates 36, 37 towards each other so that they grip the sheaf.

Figure 1:
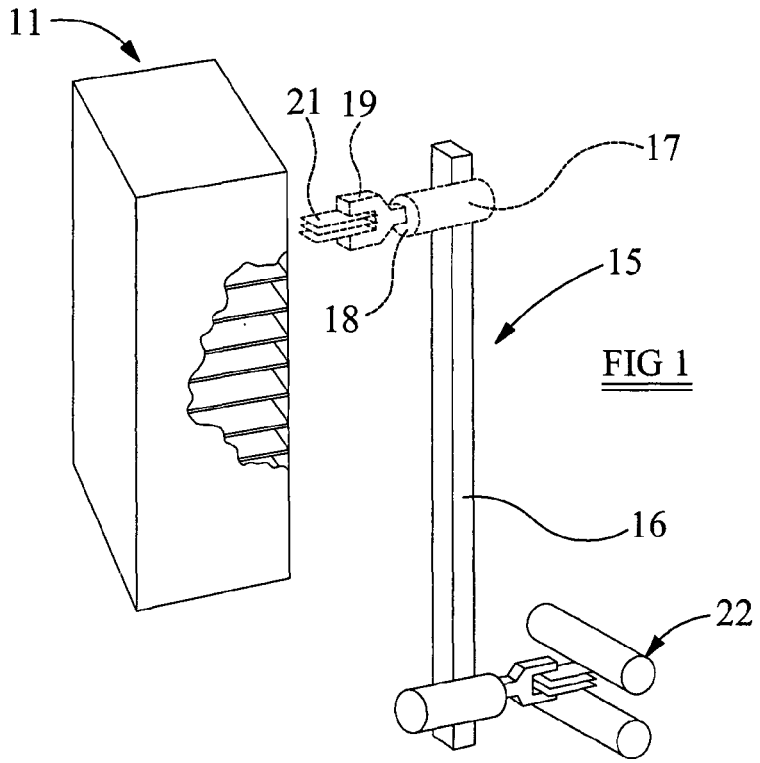
FIG. 1 is a diagrammatic illustration of a prior art cash storage unit and a pick and place mechanism.

The carrier with a sheaf of notes securely gripped between the gripper plates 36, 37, is then conveyed to a receiving location, for example adjacent a storage unit such as the storage unit 11 of FIG. 1. The sheaf of notes is now extracted from the carrier using an extractor mechanism. In principle this is similar to the "pick and place" device of FIG. 1. However, in the system of this invention, the carrier is brought to rest at the receiving station and is orientated so that the mouth of the gripper plates is aligned with extractor (as described above using the cut-outs 56*a*, 56*b*). The carrier is opened, as above. The extractor has essentially the same form as the device 60 of the depositing arrangement without the arms 64*a,b*. That is to say, the extractor has jaws that grip the sheaf and is positioned so that the jaws come together to contact the top and bottom of the sheaf at the rectangular cut-outs 40*a,b* in the upper and lower gripper plates 36, 37. Moreover, the jaws of the extractor are brought together with a mechanism that applies a force that is greater than the biasing force of the helical springs 52*a-d* of the gripper 35. Thus, when the extractor moves away from the carrier the sheaf of notes is pulled out of the gripper 35.

Figure 9:
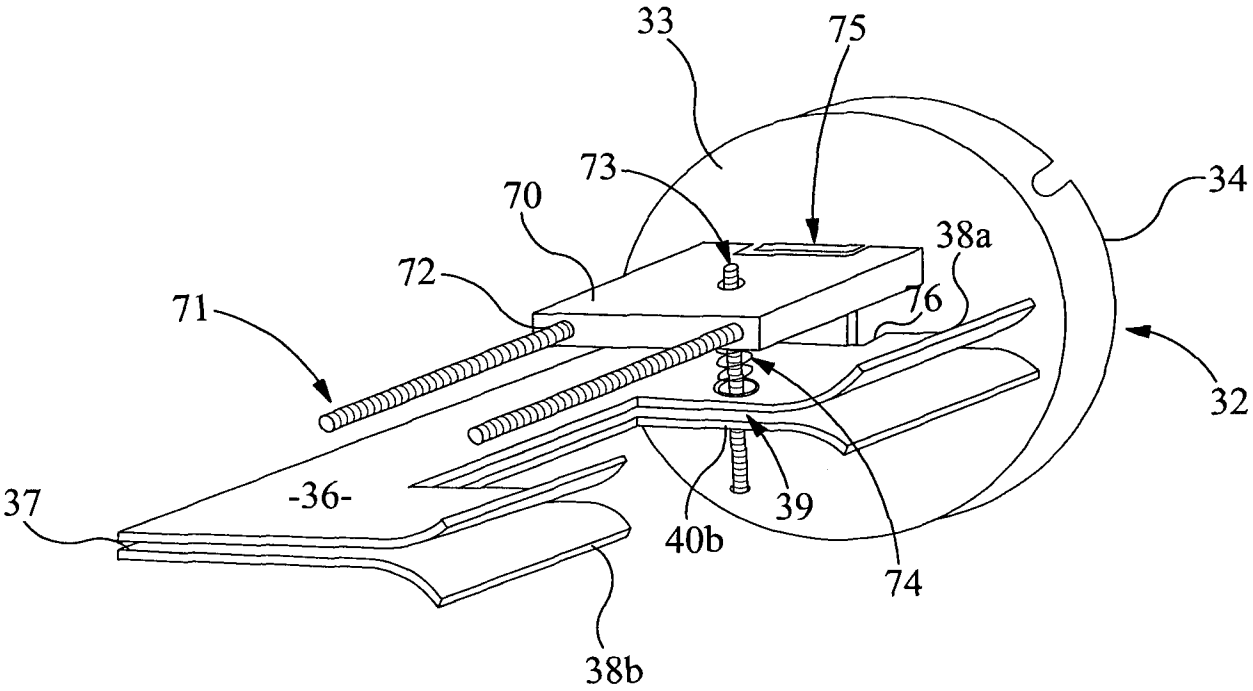
FIG. 9 illustrates part of an alternative arrangement of a carrier in accordance with the present invention.

It will be appreciated by one of skill in the art, that the precise arrangement of the gripper mechanism may be varied without altering the principles of the invention. For example, as shown in FIG. 9 (where equivalent features are referred to with the same reference numerals) the frames 44*a*, 44*b* of the carrier of FIG. 3 are replaced with upper blocks 70 (only one of which is shown) located above and generally parallel to the upper gripper plate 36, and corresponding lower blocks (not shown) underneath the lower gripper plate 37. The blocks 70 are interconnected with horizontal (as shown) threaded rods 71 screwed into threaded receiving holes 72. Vertical threaded rods 73 extend between each upper block 70 and the corresponding lower block, passing through aligned holes 74 in the gripper plates 36, 37. The vertical threaded rods 73 pass axially through helical compression springs 74. Finally, the end pieces 32 each have a guide block 75 on the inner circular face 33, which aligns with cut-outs 76 in the gripper plates 36, 37 and replace the cut-outs 42*a-d* and vertical frame end members 48*a,b* of the arrangement shown in FIG. 3.

An alternative embodiment of a cylindrical carrier 160 of a type suitable for use in a pneumatic tube conveyor system, is shown in FIGS. 12 to 15. The carrier 160 has a diameter which may be less than the width of the banknotes to be carried. In the preferred arrangement shown in FIG. 12, the carrier 160 is essentially cylindrical in form having two circular end-pieces 161*a*, 161*b* with a carrier body 168 extending between the end-pieces 161*a*, 161*b*. The skilled person will appreciate that alternative constructions to an essentially cylindrical carrier are also possible without departing from the principles of the invention. The body 168 has an opening 163 for the insertion and extraction of notes, and through which is visible a part 162 of a moveable gripper.

Figure 13:
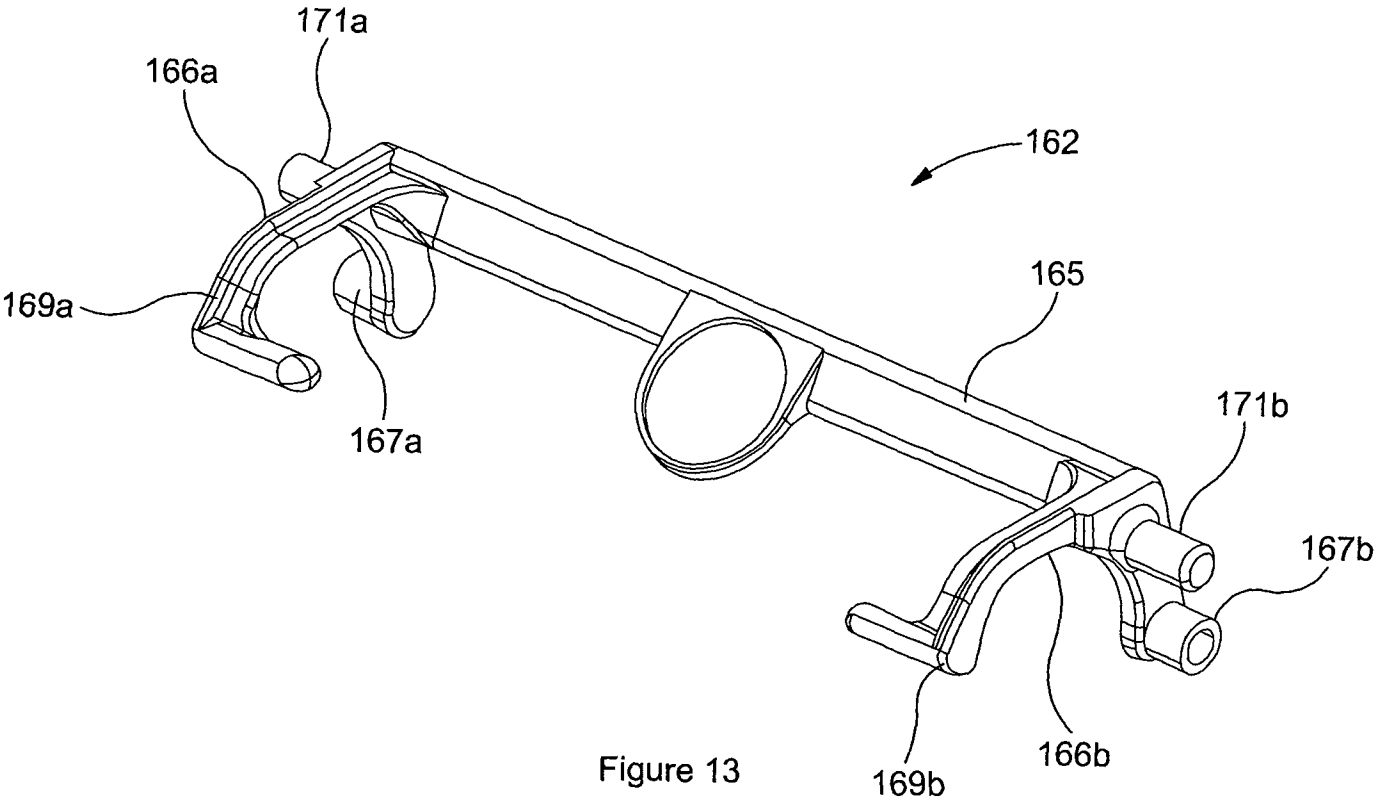
FIG. 13 is an illustration of part of a gripper of the carrier of FIG. 12.

An exemplary gripper part 162 is shown in isolation in FIG. 13. The gripper part 162 comprises a longitudinal gripper bar or plate 165 extending between opposing arm arrangements 166*a*, 166*b*. Each arm arrangement 166*a*, 166*b* has a pivot mounting 167*a*, 167*b* aligned such that the gripper bar 165 is radially off-set from a pivot axis passing through the pivot mountings 167*a*, 167*b*. The arm arrangements 166*a*, 166*b* also each have a forward-reaching arm 169*a*, 169*b* extending from the gripper bar 165. Also, extending in an axial direction at each end of the gripper part 162, are respective lugs 171*a*, 171*b*.

Figure 14:
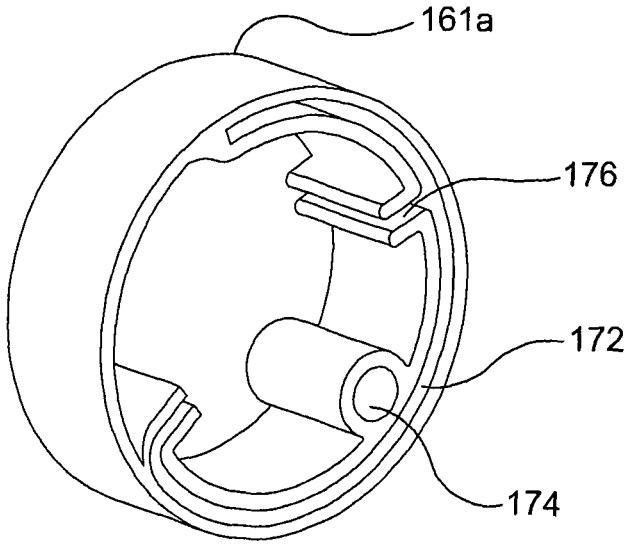
FIG. 14 is an illustration of an end-piece forming part of the carrier of FIG. 12.

FIG. 14 shows an end-piece 161*a* in isolation. The end-piece 161*a* is typically formed of a molded plastics material and is shaped to include a groove 172 extending around a substantial portion of the circumference of the end-piece 161*a*, for receiving one end of the carrier body 168, as well as a pivot opening 174 for receiving the pivot mounting 167*a* of the gripper part 162. The end-piece 161*a* also has a shaped detent 176 for receiving a flat spring (not shown). The opposing end-piece 161*b* is essentially a mirror image of the end-piece 161*a*.

The flat springs are disposed in each end-piece 161*a*, 161*b* such that when the gripper part 162 is located with the pivot mountings 167*a*, 167*b* received in the respective pivot openings 174 of in the end-pieces 161*a*, 161*b*, then the springs exert a force against the lugs 171*a*, 171*b* so as to push the plate 165 towards an inner wall of the carrier body 168. However, a force can be applied from outside of the carrier 160 against the forward-reaching arms 169*a*, 169*b* against the action of the springs so as to move the plate 165 away from the wall of the carrier body 165. The carrier 160 may thus be opened for manual insertion of the sheaf, for example using a specifically designed insertion clip that presents the notes/sheaf in the correct way. The gripper 162 is then released and the notes are held under force. The design of the carrier body 168, with the opening 163 and gripper 162 enables the notes to be held in place during transfer and also removed from the carrier 160 without having to open it again. Also, the pivotal gripper opening mechanism is designed so that the arms 169*a*, 169*b* extend radially outside the carrier body 168 when the gripper 162 is opened, meaning that the carrier 160 cannot be entered into the tube system while it is still open.

Figure 15:
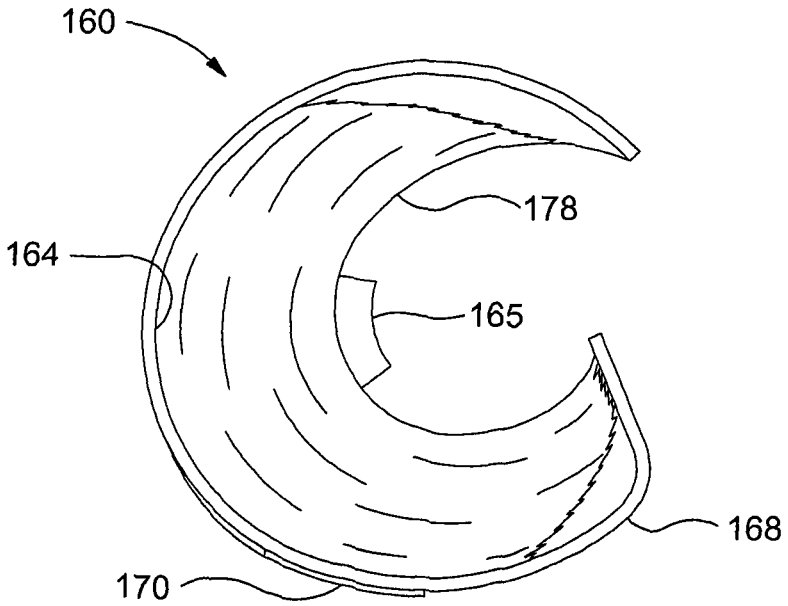
FIG. 15 is a cross-section through the carrier of FIG. 12 with a sheaf of notes inside.

As shown in cross-section in FIG. 15, inside the carrier 160 a sheaf of notes 178 is gripped between the gripper plate 165 and a curved surface 164. As shown, the curved surface 164 may be an internal surface of a wall forming part of the body 168 of the carrier 160. The curved surface 164 therefore forms a first, stationary "plate", while the moveable gripper plate 165 acts as a second, moveable "plate", which runs parallel to the curved surface 164 in the longitudinal (i.e. axial) direction of the cylindrical carrier 160. The sheaf of notes 178 adopts a curved profile against the curved surface 164 and is thus able to fit inside the carrier 160 even though the individual notes have a width greater than the diameter of the carrier 160.

As with the carrier 30, the moving gripper 162 is part of a gripping mechanism that biases it towards the curved surface 166 to grip the sheaf of notes 164. Also, as with the carrier 30, the moving gripper is biased with a gripping force to grip the sheaf 178, although only a portion of the sheaf 178 is contacted by the gripper plate 165, leaving other parts that are not gripped thereby enabling an external gripping mechanism to extract the sheaf by exerting a greater force than the gripping force. The opening 163 in the carrier body 168 allows access to the interior by the external gripping device to extract the sheaf 178. A moveable lid, or covering (not shown) may be provided to cover the opening 163 when the carrier 160 is being conveyed.

Figure 12:
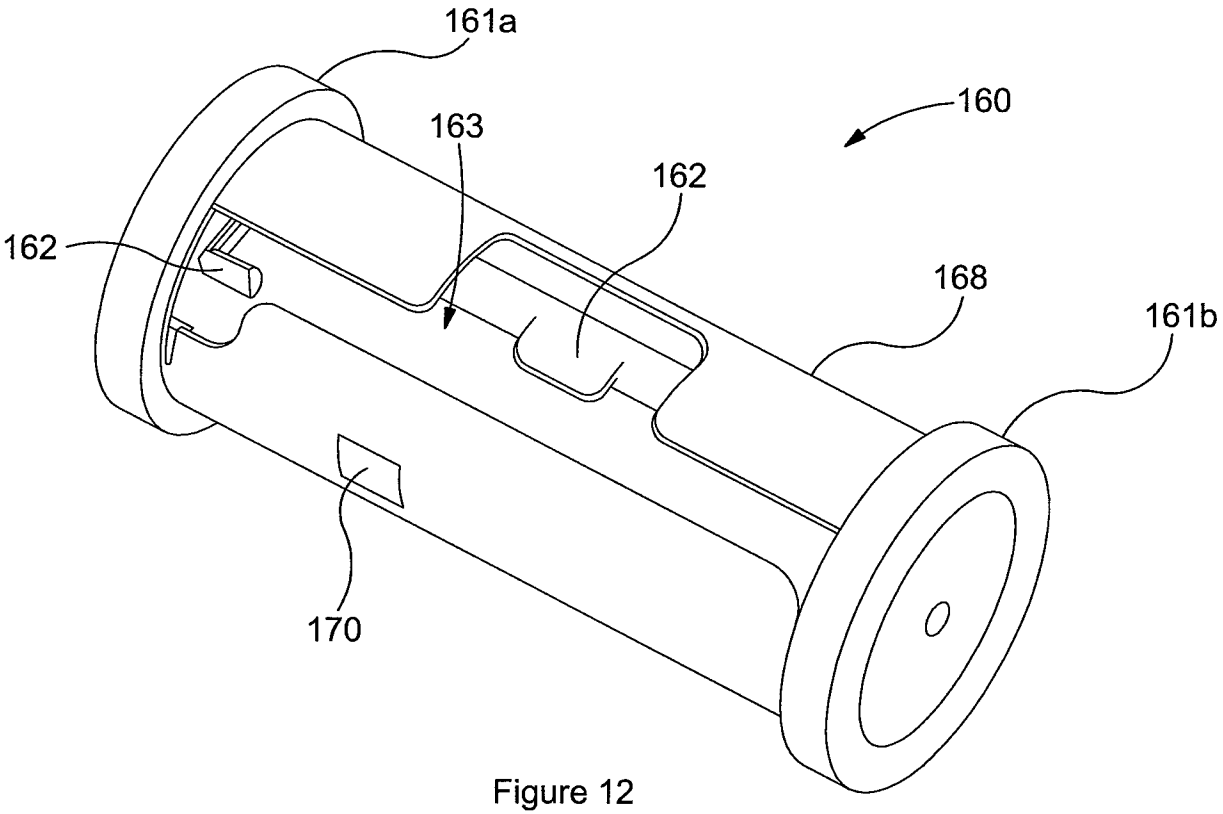
FIG. 12 is an illustration of another embodiment of a carrier in accordance with aspects of the present invention.

The carriers 30, 160 described above may also include an RFID tag, as shown by reference numeral 170 on the carrier 160 of FIGS. 12 and 15. The RFID tag 170 is shown attached to an outer surface of the carrier body, although any suitable location on the carrier could be used. A similar RFID tag, although not shown, may be provided on the carrier 30 of FIGS. 3-7 and 9. The RFID tag 170 carries information that includes, for example, a carrier ID, details of the sender/send station and optionally information about the value and denominations of the notes being transported. This information may be written to the RFID tag 170 at the point of sending and read from it at the receiving station. System software, to be described further below, may then be used to compare the read RFID information with records of deposits made, and may perform various control, signalling or messaging functions depending on the result. In addition data read from the RFID tag 170 may be used by the software system in controlling the operation of the pneumatic tube conveyor system, or of the pick and place mechanism, or both.

Figure 10:
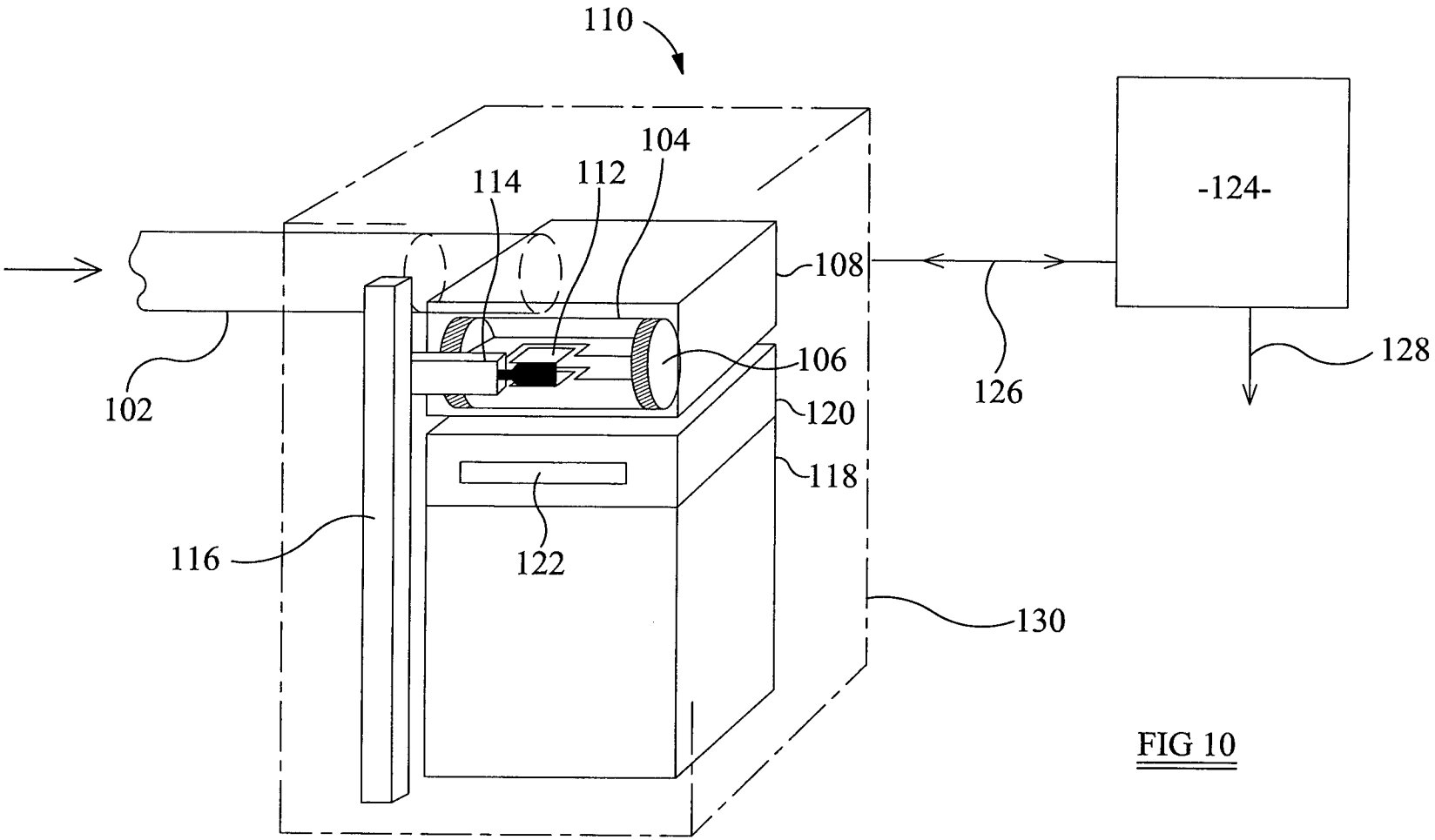
FIG. 10 illustrates a bank note processing system in accordance with an aspect of the invention.

Referring to FIG. 10, a system for processing notes, such as bank notes, includes a conveyor apparatus 102. Conveyor apparatus 102 is preferably a pneumatic tube conveyor, of a type described above. The conveyor apparatus 102 conveys a carrier 104, which is of a type as described above and depicted in FIGS. 3-7 or FIGS. 12-15. The carrier 104 has a gripper 106 for gripping a sheaf of notes, for example bank notes (not shown). The carrier 104 is shown positioned at a carrier receiving station 108, which is part of a processing station 110.

When the carrier 104 is received at the carrier receiving station 108 it is positioned so that the gripper 106 is aligned with an extractor 112 for extracting the sheaf of notes from the carrier 104. As described above in relation to FIGS. 3 to 7 and 12, the gripper 106 in the carrier 104 is resiliently biased for gripping the sheaf with a first gripping force. The extractor 112 also includes a gripper, which grips the sheaf with a second gripping force, greater than the first gripping force, in order to extract the sheaf from the carrier 104. The extractor 112 is part of a "pick and place mechanism" (similar to that described above in relation to FIGS. 1 and 2) and is carried on an arm 114 that is moved along a rail 116 or track.

The carrier receiving station 108 is positioned adjacent to (above in the embodiment shown), a note processor 118. The note processor includes a note receiver 120, with a slot 122 into which the notes are inserted by the extractor 112 after they have been extracted from the carrier 104. The note processor may include one or more of a variety of automated note processing operations such as a note counter, a note validator or a note recycler. After processing the notes are stored in the processing station 110 until they are either recycled, or collected/emptied.

The operation of the processing station is controlled by a controller 124. The controller 124 is implemented in a computer programmed with software for controlling operation of the system. The controller 124 is shown located outside the processing station 110, with a data communications link 126 between them. However, part or all of the controller 124 may be housed inside the processing station 110.

The processor 124 computer includes a link and/or data output 128 for communication with a central processor, which, for example, could be a central accounting computer of a bank. The system thus has the ability to provide management and audit information based on the notes that have been processed, either locally or to a central processing point (such as a bank's central accounting computer).

As shown by the chain-dotted lines in FIG. 10, the processing station 110 is enclosed within a housing 130. The housing 130 is preferably constructed in accordance with ATM and/or safe grading standards, and for example may be constructed of concrete and/or steel.

Figure 11:
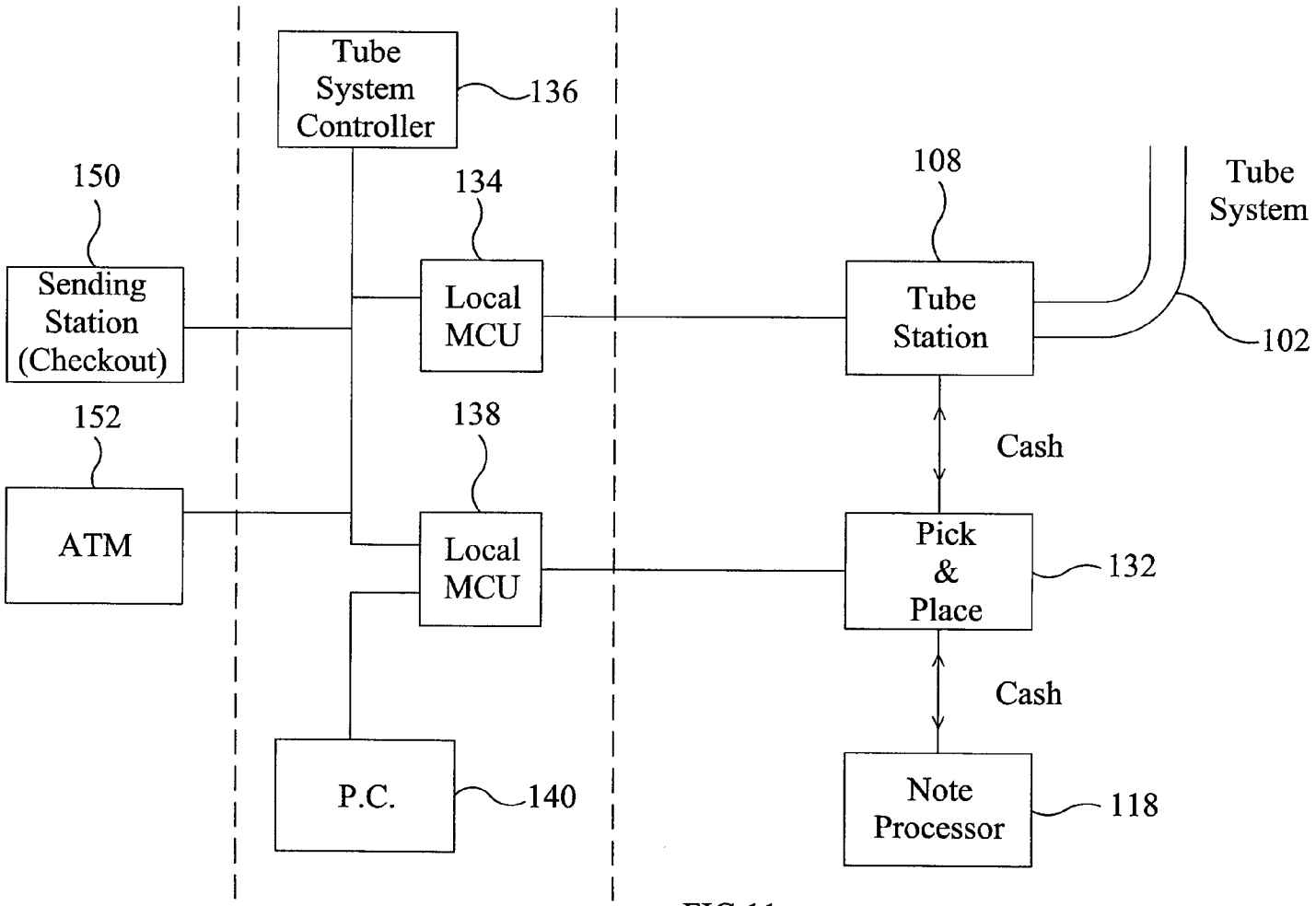
FIG. 11 is a schematic block diagram illustrating the functionality and control of the bank note processing system of FIG. 10.

FIG. 11 is a schematic block diagram illustrating the functionality and control of the bank note processing system of FIG. 10, and shows in more detail exemplary components that go to make up the controller 124. As shown in FIG. 11, the system includes: the pneumatic conveyor tube 102, through which carriers are delivered to and dispatched from the tube station 108; a pick and place mechanism 132 (including, for example, extractor 112 carried on arm 114 movable along rail 116 as described above and shown in FIG. 10); and the note processor 118. Notes are transferred between the tube station 108 and the note processor 118 by means of the pick and place mechanism 132. The tube system may further include one or more carrier sorting devices. A carrier sorting device is a unit which is set in line in the tube system to store and manage the carriers sent from the send stations to the tube station 108. This enables the send stations to send carriers at will rather than wait for the system to be ready for them to be received at the tube station 108.

The controller 124 includes a local tube station micro-controller unit 134, which controls the operation of the tube station 108 under instructions from a pneumatic tube system controller 136, which also controls operation of other parts of the pneumatic tube conveyor system, including a sending station 150, and, if used, the carrier sorting device. A second local micro-controller unit 138 controls operation of the pick and place mechanism 132 and the note processor 118, under instructions from a computer 140 (such as a p.c.). Control and data communications are provided by way of suitable cable or wireless means between the various control and hardware components. As shown this may also include data provided from an ATM 152 (automated teller machine) to/from which bank notes are supplied by way of the pneumatic tube system.

The system has differing software components operating through the micro controller units 134, 138 and through the computer 140.

The computer 140 is programmed with software that provides a graphical user interface with differing levels of security to allow for access to administrative and system setup and control parameters as well as reporting. The computer 140 has a memory for storing data, which hosts a database of information with records of the details of transactions throughout the system and log files of system operation. Data recorded may include, but is not be limited to: time, sender and date of carriers sent from a point of sale or teller; value sent; value received by denomination; status of send (e.g. complete, or notes rejected, or incomplete); money withdrawn from system; money dispensed to ATM; money not taken from ATM; value at ATM; cumulative value of notes held; error messages.

System status is displayed graphically and set up parameters are input via the computer 140 to set up and update the system. Remote updating and monitoring is also possible.

The computer 140 communicates with the micro controller units 134 138. This may be through a master controller (not shown) which manages zones on the system. Software that operates through the master controller and/or micro-controller units 134, 138 controls running of the pneumatic tube systems, the RFID tag read and write hardware, the carrier sorting device, the receiving stations, the robotics for the mechanical handling (e.g. the pick and place mechanism) and the interfaces with third party hardware.

The invention claimed is:

1. A carrier for transporting a sheaf of notes through a conveyor, the carrier comprising a gripper having a gripper plate moveable towards a wall of the carrier for gripping the sheaf, and a biasing arrangement configured to bias the gripper plates towards the wall of the carrier with a predetermined gripping force, wherein the gripper plate is shaped so that a portion of the sheaf is not gripped between the plate and the wall of the carrier thereby permitting extraction of the sheaf by an extractor gripping the sheaf at said portion with a force that is greater than the predetermined gripping force.

2. The carrier of claim 1 wherein the carrier is of a cylindrical form, the sheaf of notes being gripped between the gripper plate and an inner wall surface of the carrier, such that the sheaf adopts a curved profile.

3. The carrier of claim 2 wherein the carrier has a diameter that is less than a width of the notes in the sheaf when laid flat.

4. The carrier of claim 1 further comprising a programmable RFID tag carrying information readable by an RFID scanner.

5. The carrier of claim 4 wherein the RFID tag carries information that includes, at least one of: a carrier ID, details of a sender, information relating to a send station, and information about the value and denominations of the notes being transported.

6. A cash dispensing system comprising:

an automatic teller machine (ATM) having an outlet through which bank notes are dispensed to customers and a local storage unit for storing the bank notes;

a pneumatic tube conveyor system adapted to convey a carrier from a remote storage location to the ATM, wherein the carrier comprises a gripper mechanism that grips a sheaf of banknotes in the carrier, and wherein the carrier includes a programmable RFID tag programmed with data;

an RFID scanner for reading data from the RFID tag;

a pick-and-place mechanism for removing bank notes from the carrier and depositing the bank notes for storage in the local storage unit; and a software system controlling operation of the pneumatic tube conveyor system and the pick-and-place mechanism.

7. The cash dispensing system of claim 6 wherein the software system is configured to compare information read from the RFID tag with records of deposits made, and to perform a function depending on the result.

8. The cash dispensing system of claim 6 wherein the software system is configured to perform a signalling function depending on the result of the comparison.

9. The cash dispensing system of claim 6 wherein the software system is configured to control the pneumatic tube conveyor system in response to information read from the RFID tag in the carrier.

10. The cash dispensing system of claim 6 wherein the software system is configured to control the pick-and-place mechanism in response to information read from the RFID tag in the carrier.

11. The cash dispensing system of claim 6 wherein the software system is configured to control the pneumatic tube conveyor system and the pick-and-place mechanism in response to information read from the RFID tag in the carrier.

12. The cash dispensing system of claim 6 wherein the RFID tag is programmed with information that includes at least one of a carrier ID, details of the sender, information relating to the send station, and information about the value and denominations of the notes being transported.

13. The cash dispensing system of claim 6 wherein the software system has two software components, one operated through micro controller units and one through a computer.

14. The cash dispensing system of claim 13 wherein the computer is programmed with software that provides a graphical user interface with differing levels of security to allow for access to administrative and system setup and control parameters and for reporting.

15. The cash dispensing system of claim 14 wherein the computer has a memory for storing data, which hosts a database of information with records of the details of transactions and log files of system operation.

16. The cash dispensing system of claim 15 wherein the computer is configured to store data in the memory that comprises at least one of: time, sender and date of carriers sent from a point of sale or teller; value sent; value received by denomination; status of send; money withdrawn from system; money dispensed to ATM; money not taken from ATM; value at ATM; cumulative value of notes held; error messages.

17. The cash dispensing system of claim 14 wherein the computer is programmed to graphically display a system status.

18. The cash dispensing system of claim 14 wherein set up parameters are input via the computer to set up and update the system.

19. The cash dispensing system of claim 14 further configured to enable remote updating and monitoring.

20. The cash dispensing system of claim 13 wherein the computer is configured to communicate with the micro controller units through a master controller.

21. The cash dispensing system of claim 20 wherein the software that operates through the master controller controls running of the pneumatic tube system, an RFID tag read and write hardware, and robotics for the pick and place mechanism.

22. The cash dispensing system of claim 6 wherein the software system is further operable for controlling one or more carrier send stations.

23. The cash dispensing system of claim 6 wherein the software system is further operable for controlling one or more carrier sorting devices.

* * * * *